US007955509B2

(12) United States Patent
Nozu

(10) Patent No.: US 7,955,509 B2
(45) Date of Patent: Jun. 7, 2011

(54) MANUFACTURING METHOD OF LIQUID DISCHARGE HEAD AND ORIFICE PLATE

(75) Inventor: Satoshi Nozu, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 935 days.

(21) Appl. No.: 11/855,304

(22) Filed: Sep. 14, 2007

(65) Prior Publication Data

US 2008/0081387 A1 Apr. 3, 2008

(30) Foreign Application Priority Data

Oct. 3, 2006 (JP) ..... 2006-271923
Mar. 26, 2007 (JP) ..... 2007-078904

(51) Int. Cl.
*B41J 2/16* (2006.01)

(52) U.S. Cl. ..... 216/27; 29/25.35; 29/890.1; 438/21

(58) Field of Classification Search ..... None
See application file for complete search history.

(56) References Cited

U.S. PATENT DOCUMENTS 5,513,431 A * 5/1996 Ohno et al. ..... 29/890.1
6,378,996 B1 * 4/2002 Shimada et al. ..... 347/70
6,912,759 B2 * 7/2005 Izadnegahdar et al. ..... 29/25.35
7,571,991 B2 * 8/2009 Sugimoto ..... 347/68
2005/0001883 A1 * 1/2005 Shin et al. ..... 347/63
2007/0019033 A1 * 1/2007 Sim et al. ..... 347/47
2008/0165228 A1 * 7/2008 Kang et al. ..... 347/68
2009/0020504 A1 * 1/2009 Yoo et al. ..... 216/27
2010/0167433 A1 * 7/2010 Lee et al. ..... 438/21

FOREIGN PATENT DOCUMENTS

JP 5-229128 A 9/1993
JP 11-227204 A 8/1999
JP 2001-205808 A 7/2001

* cited by examiner

*Primary Examiner* — Anita K Alanko
(74) *Attorney, Agent, or Firm* — Fitzpatrick, Cella, Harper & Scinto

(57) ABSTRACT

There is disclosed a manufacturing method in which depths of individual liquid chambers can be set to be small. The manufacturing method is a manufacturing method of a liquid discharge head having a liquid chamber which communicates with a discharge port for discharging a liquid, and includes: etching a first Si layer of an SOI substrate by use of an insulating layer as an etching stop layer to form the liquid chamber at the first Si layer, the SOI substrate being constituted by the first Si layer, the insulating layer and a second Si layer in this order; and removing a part or all of the second Si layer.

9 Claims, 17 Drawing Sheets

MANUFACTURING METHOD OF LIQUID DISCHARGE HEAD AND ORIFICE PLATE

BACKGROUND OF THE INVENTION

1. Field of the Invention

The present invention relates to a manufacturing method of a liquid discharge head and an orifice plate, including discharge ports which discharge liquid droplets, individual liquid chambers which communicate with these discharge ports, and a piezoelectric member which is disposed in a vibration plate constituting a part of the individual liquid chambers and which is given a displacement that changes with an elapse of time to discharge the liquid droplets. The liquid discharge head of the present invention is applicable to an ink jet recording device which prints information on paper, cloth, leather, non-woven cloth and OHP sheet, a patterning device which attaches a liquid to a solid such as a substrate or a plate material, and a coating device. The liquid discharge head will hereinafter be referred to as typically the "ink jet head".

2. Description of the Related Art

Heretofore, an ink jet head is incorporated for a broad range of application in recording devices such as a printer and a facsimile machine for reasons such as low noise, low running cost, a reason that the device is easily miniaturized and a reason that color printing is easily performed. Especially, applications of an ink jet head using a piezoelectric member have been enlarged as a patterning device for manufacturing a device owing to a high degree of freedom in selection of a liquid to be discharged.

The ink jet head generally has a channel substrate including a liquid channel, individual liquid chambers disposed at a first surface of the channel substrate, through paths extending from the individual liquid chambers to a second surface of the channel substrate, and an orifice plate bonded to the second surface of the channel substrate and provided with discharge ports which communicate with the through paths. To discharge ink droplets, the individual liquid chambers need to be pressurized. Examples of means for generating a pressure in the individual liquid chambers include a bubble type which foams the liquid with heat generators installed in the individual liquid chambers to discharge liquid droplets and a piezo type which deforms a vibration plate forming a part of the individual liquid chambers with a piezoelectric element to form the liquid droplets. Furthermore, an electrostatic type is also known which deforms the vibration plate with an electrostatic force to discharge the liquid droplets.

In such an ink jet head, in recent years, with a request for high definition of a formed image, the individual liquid chambers of the channel substrate and pressure generation sources such as the piezoelectric element are highly densely arranged in large amounts to achieve high integration. To meet such requirements, a piezo type ink jet head is proposed. In the head, electrodes and the piezoelectric member are formed on the whole surface of the vibration plate by a film forming technology, and the electrodes for the individual liquid chambers and the piezoelectric member are processed using a photolithography technology. Since the film forming technology and the photolithography technology are used, a highly dense ink jet head is realized.

Moreover, Japanese Patent Application Laid-Open No. H11-227204 discusses a technology in which electrodes and a piezoelectric film are formed on an Si substrate, and Si is then processed by anisotropic etching to highly precisely form the individual liquid chambers. However, in such an ink jet head, depths of the individual liquid chambers depend on a thickness of the substrate. The depths of the individual liquid chambers cannot freely be set. When the ink jet head is prepared using a comparatively large substrate having a size of six or eight inches, the substrate having a certain degree of thickness needs to be used so as to be easily treated during manufacturing. Therefore, the individual liquid chambers deepen. Especially the highly dense ink jet head has a structure including thin partition walls which separate the individual liquid chambers from one another, and the deep individual liquid chambers. Therefore, there are problems that sufficient rigidity is not obtained, crosstalk is generated and a desired discharge performance is not obtained.

To solve such a problem, Japanese Patent Application Laid-Open No. 2001-205808 discusses a manufacturing method in which grooves forming pressure generation chambers are formed at a single-crystal Si layer of an SOI substrate. After forming a sacrifice layer on the grooves, the vibration plate is formed. Finally, the sacrifice layer is removed to form shallow pressure generation chambers.

Moreover, Japanese Patent Application Laid-Open No. H05-229128 discusses a technology in which Si is processed from one surface of an Si substrate by use of anisotropic etching. In consequence, the individual liquid chambers and the through paths are formed at the Si substrate.

However, the manufacturing method of Japanese Patent Application Laid-Open No. 2001-205808 includes a complicated step of filling the grooves with the sacrifice layer. Moreover, the sacrifice layer is removed via narrow channels. There is also a problem that the sacrifice layer cannot completely be removed from the pressure generation chambers.

Furthermore, in the technology of Japanese Patent Application Laid-Open No. H05-229128, the liquid channels are formed using the anisotropic etching of Si. Since the depths of the liquid channels depend on widths thereof, both of the width and the depth of the liquid channel cannot be set to desired dimensions. Furthermore, in the technology of the Japanese Patent Application Laid-Open No. H05-229128, dimensions of the liquid channels also depend on a thickness of an Si wafer, and discharge ports cannot be formed separately into free dimensions. In addition, to prepare the highly dense ink jet head, the liquid channels need to be further miniaturized with high precision, and a constitution and a manufacturing method to achieve such an ink jet head are demanded.

SUMMARY OF THE INVENTION

An object of the present invention is to provide a manufacturing method in which depths of individual liquid chambers can be set to be small.

Another object of the present invention is to provide an orifice plate in which channel constitutions of a liquid can be formed with high precision.

The present invention is directed to a manufacturing method of a liquid discharge head having a liquid chamber which communicates with a discharge port for discharging a liquid, the method comprising: etching a first Si layer of an SOI substrate by use of an insulating layer as an etching stop layer to form the liquid chamber at the first Si layer, the SOI substrate being constituted by forming the first Si layer, the insulating layer and a second Si layer in this order; and removing a part or all of the second Si layer.

Moreover, the present invention is directed to a manufacturing method of a liquid discharge head having a liquid chamber which communicates with a discharge port for discharging a liquid, the method comprising: etching a first Si layer of a first SOI substrate by use of a first insulating layer as an etching stop layer to form the discharge port at the first Si layer, the first SOI substrate being constituted by forming the first Si layer, the first insulating layer and a second Si layer in this order; etching a third Si layer of a second SOI substrate by use of a second insulating layer as an etching stop layer to form the liquid chamber at the third Si layer, the second SOI substrate being constituted by forming the third Si layer, the second insulating layer and a fourth Si layer in this order; and bonding the first Si layer to the third Si layer so that the discharge port communicate with the liquid chamber.

Furthermore, the present invention is directed to a manufacturing method of an orifice plate having a discharge port which discharges a liquid and a communication portion which communicates with the discharge port, the method comprising: etching a first Si layer of a first SOI substrate by use of a first insulating layer as an etching stop layer to form the discharge port at the first Si layer, the first SOI substrate being constituted by forming the first Si layer, the first insulating layer and a second Si layer in this order; etching a third Si layer of a second SOI substrate by use of a second insulating layer as an etching stop layer to form the communication portion at the third Si layer, the second SOI substrate being constituted by forming the third Si layer, the second insulating layer and a fourth Si layer in this order; bonding the first Si layer to the third Si layer; and removing the second Si layer and the fourth Si layer.

In addition, the present invention is directed to a manufacturing method of a liquid discharge head including an orifice plate having a discharge port which discharges a liquid and a communication portion which communicates with the discharge ports, and a channel substrate provided with a liquid chamber which communicates with the communication portion, the method comprising: etching a first Si layer of a first SOI substrate by use of a first insulating layer as an etching stop layer to form the discharge port at the first Si layer, the first SOI substrate being constituted by forming the first Si layer, the first insulating layer and a second Si layer in this order; etching a third Si layer of a second SOI substrate by use of a second insulating layer as an etching stop layer to form the communication portion at the third Si layer, the second SOI substrate being constituted by forming the third Si layer, the second insulating layer and a fourth Si layer in this order; bonding the first Si layer to the third Si layer; removing the fourth Si layer; bonding the third Si layer to the channel substrate so that the communication portion communicates with the liquid chambers; and removing the second Si layer.

According to the manufacturing method of the liquid discharge head of the present invention, depths of individual liquid chambers can be set to be small.

Moreover, according to the manufacturing method of the orifice plate of the present invention, channel constitutions of the liquid can be formed with high precision.

Further features of the present invention will become apparent from the following description of exemplary embodiments with reference to the attached drawings.

DESCRIPTION OF THE EMBODIMENTS

Next, embodiments of the present invention will be described with reference to the drawings.

First Embodiment

Figure 1:
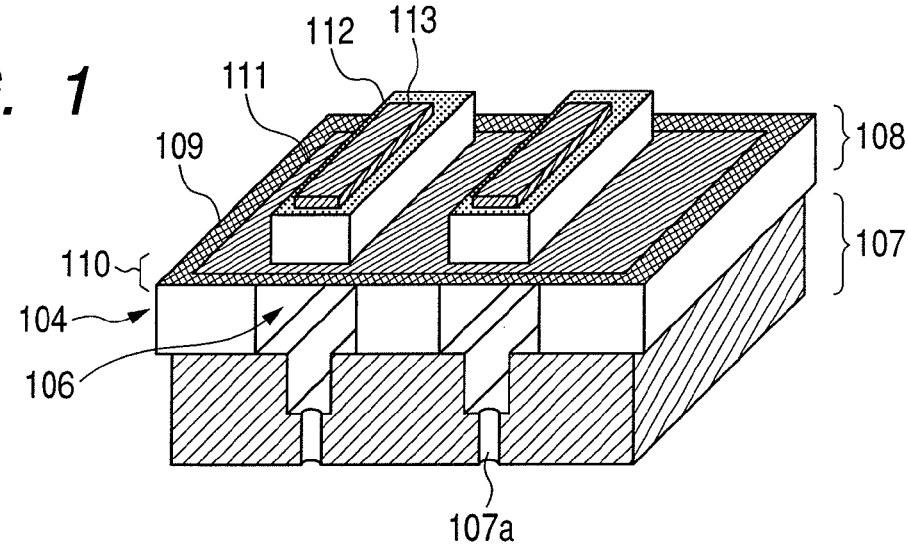
FIG. 1 is a perspective view schematically illustrating an ink jet head according to a first embodiment of the present invention.

FIG. 1 is a perspective view schematically illustrating an ink jet head according to a first embodiment.

As shown in FIG. 1, the ink jet head of the present embodiment has a channel substrate 108 in which a plurality of individual liquid chambers 106 are formed. The channel substrate 108 includes a part of a silicon on insulator (SOI) substrate 104. An $SiO_2$ layer 109 is formed on the surface of the SOI substrate 104 forming the channel substrate 108, on which an insulating layer 102 (see FIGS. 2A to 2C) is formed. Substantially on the whole surface of the $SiO_2$ layer, a lower electrode 111 is further formed. Furthermore, on a position of the lower electrode 111 which faces each of the individual liquid chambers 106, a piezoelectric thin film 112 having a shape extending along each of the individual liquid chambers 106 in a longitudinal direction is disposed. An upper electrode 113 is disposed on each piezoelectric thin film 112. These lower electrode 111, piezoelectric thin film 112 and upper electrode 113 constitute a piezoelectric element. An orifice plate 107 provided with discharge ports 107*a* is disposed on the other surface of the SOI substrate 104 forming the channel substrate 108.

According to the ink jet head of the present embodiment constituted in this manner, when a voltage is applied between the lower electrode 111 and the upper electrode 113, the piezoelectric thin film 112 is deformed. When the piezoelectric thin film is deformed, a vibration plate 110 (see FIGS. 2D to 2F) including the $SiO_2$ layer 109 is deformed. In consequence, a liquid such as ink stored in the individual liquid chambers 106 which come in contact with the vibration plate 110 is pressurized, and discharged as liquid droplets from the discharge ports 107*a* of the orifice plate 107.

Next, a manufacturing method of the ink jet head according to the present embodiment will be described with reference to FIGS. 2A to 2F.

Figure 2A:
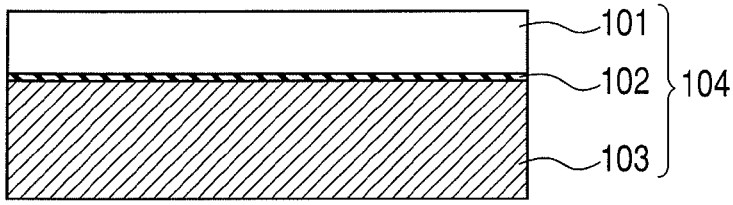
FIGS. 2A, 2B, 2C, 2D, 2E and 2F are diagrams illustrating a manufacturing method of an ink jet head according to the first embodiment of the present invention.

As shown in FIG. 2A, the SOI substrate 104 having a size of six inches is prepared in which a first Si layer 101 has a thickness of 50 μm, the insulating layer 102 has a thickness of 1 μm and a second Si layer 103 has a thickness of 200 μm.

Figure 2B:
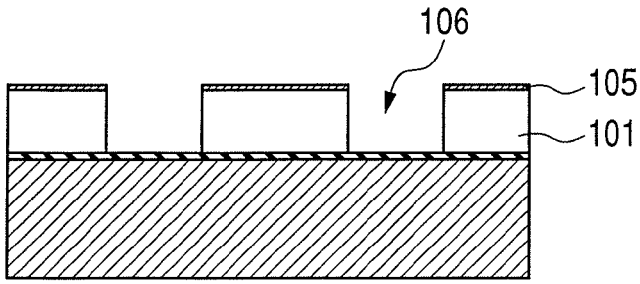

Subsequently, as shown in FIG. 2B, an etching mask 105 is disposed on the side of the first Si layer 101, and etching is performed using the insulating layer 102 as an etching stop layer to form the individual liquid chambers 106. During the etching, an inductively coupled plasma (ICP) etching device known as a deep etching technology of Si is used. In the present embodiment, the etching is performed using $CF_4$ and $SF_6$ as etching gases. It is to be noted that the etching mask 105 may be formed of a resist only or formed of $SiO_2$ or SiON.

Figure 2C:
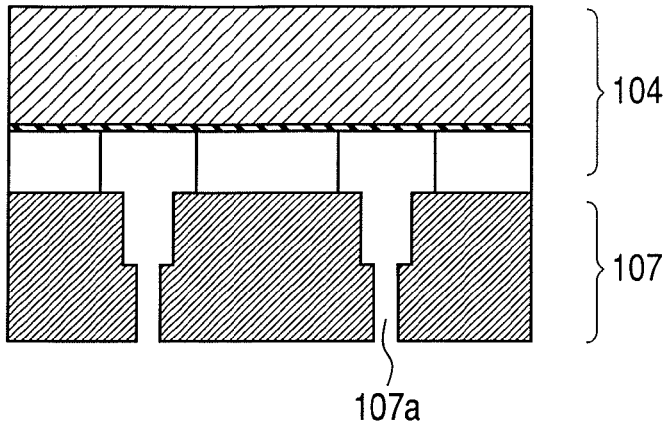

Subsequently, as shown in FIG. 2C, the SOI substrate 104 is bonded to the 200 μm thick orifice plate 107 made of Si and prepared separately from this SOI substrate 104 by use of a direct bonding technology of Si. In the present embodiment, both of the SOI substrate 104 and the orifice plate 107 are cleaned, clean Si substrates of both of them are bonded to each other, and a pressure is applied to both of them to bond them together.

Figure 2D:
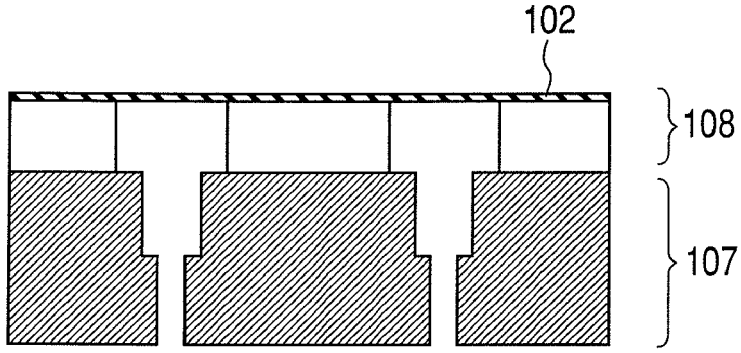

Subsequently, as shown in FIG. 2D, the second Si layer 103 is removed to constitute the channel substrate 108. In the present embodiment, the second Si layer 103 having a thickness of 200 μm is removed from the whole surface by the ICP etching device. It is to be noted that all of the second Si layer 103 does not have to be necessarily removed in a thickness direction of the layer. For example, 195 μm of the layer having the thickness of 200 μm may be etched, and 5 μm of the layer may be left on the insulating layer 102 without being etched. The second Si layer 103 may be removed by, for example, polishing, instead of a dry etching process using the ICP.

It is to be noted that the channel substrate 108 has a thickness which is as small as about 50 μm. Therefore, if the substrate is treated as a single member, it is easily cracked. However, in the present embodiment, when the channel substrate 108 is bonded to the orifice plate 107 and the only second Si layer 103 is removed, the channel substrate 108 is scarcely damaged as compared with a case where the channel substrate is treated as the single member.

Figure 2E:
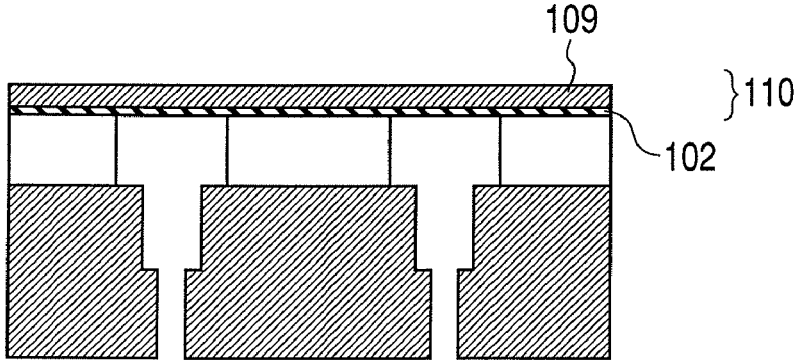

Subsequently, as shown in FIG. 2E, the $SiO_2$ layer 109 having a thickness of 3 μm is formed on the insulating layer 102 to constitute the vibration plate 110 including the insulating layer 102 and the $SiO_2$ layer 109. It is to be noted that the vibration plate 110 is not limited to this configuration, and the vibration plate may include the insulating layer 102 only. Instead of the $SiO_2$ layer 109, an insulating film of SiON or SiN, or a metal film of Pt or Au may be formed, and this film and the insulating layer 102 may constitute the vibration plate 110. When the insulating film or the metal film having desired thickness and Young's modulus is formed on the insulating layer 102, the thickness and rigidity of the vibration plate 110 can freely be designed. The thickness of the vibration plate 110 is not limited to the above thickness, and may freely be designed in consideration of dimensions of the individual liquid chambers 106.

Moreover, when a part of the second Si layer 103 is left, the second Si layer 103 of Si partially remaining on the insulating layer 102 in a film thickness direction and the insulating layer 102 of $SiO_2$ may constitute the vibration plate 110. In consequence, the second Si layer 103 made of single-crystal Si and the insulating layer 102 made of $SiO_2$ can constitute a highly rigid and highly precise vibration plate.

Figure 2F:
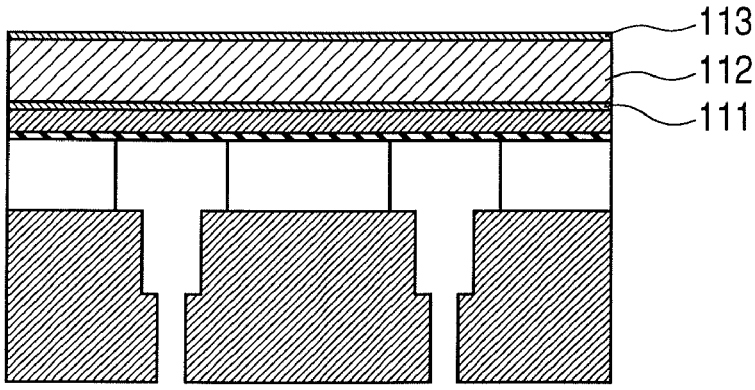

Subsequently, as shown in FIG. 2F, the lower electrode 111, the piezoelectric thin film 112 and the upper electrode 113 are formed on the vibration plate 110. To form the piezoelectric thin film 112, a bonded member including the channel substrate 108 and the orifice plate 107 is mounted in a sputtering device. Moreover, $Pb(Zr, Ti)O_3$ perovskite type oxide (hereinafter referred to as the "PZT") including lead, titanium and zirconium is formed into a film having a thickness of 3 μm on the lower electrode 111 by a sputtering process. Afterward, the bonded material is removed from the sputtering device, and fired in an oxygen atmosphere to crystallize the PZT film. In consequence, the piezoelectric thin film 112 is formed. To obtain a satisfactory piezoelectric property of the piezoelectric thin film 112, a composition of the PZT thin film is adjusted into $Pb(Zr_{0.52}Ti_{0.48})O_3$. The composition of the PZT film is not necessarily limited to the above composition, and another composition may be constituted. The thickness of the PZT film is not limited to 3 μm.

Subsequently, the upper electrode 113 is formed on the piezoelectric thin film 112. Afterward, the upper electrode 113 and the piezoelectric thin film 112 are processed so as to correspond to each of the individual liquid chambers 106 by dry etching. In consequence, the ink jet head is completed as shown in FIG. 1. It is to be noted that, in the present embodiment, the upper electrode 113 is etched using a boron chloride gas, and the piezoelectric thin film 112 is etched using a mixture gas of chlorine and fluorine.

In consequence, according to the present embodiment, the individual liquid chambers 106 are formed so that the thickness of the first Si layer 101 of the SOI substrate 104 to be prepared corresponds to a desired depth of each of the individual liquid chambers 106. After bonding the channel substrate 108 to the orifice plate 107, the second Si layer 103 is removed. Therefore, the ink jet head can be manufactured without damaging the channel substrate 108 provided with the shallow individual liquid chambers 106 and being treated during a manufacturing process.

It is to be noted that, in the present embodiment, the first Si layer 101 has a thickness of 50 μm, but the thickness of the first Si layer 101 is not limited to this dimension. The depth of each of the individual liquid chambers 106 can appropriately be selected by using the SOI substrate 104 including the first Si layer 101 having the thickness adapted to the desired depth of each of the individual liquid chambers 106.

Second Embodiment

Next, a manufacturing method of an ink jet head according to a second embodiment of the present invention will be described with reference to FIGS. 3A to 3E.

Figure 3A:
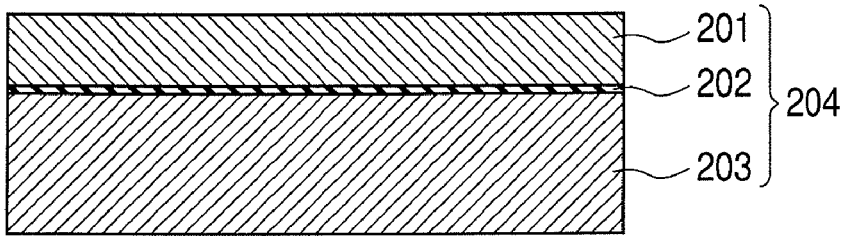
FIGS. 3A, 3B, 3C, 3D and 3E are diagrams illustrating a manufacturing method of an ink jet head according to a second embodiment of the present invention.

As shown in FIG. 3A, an SOI substrate 204 having a size of six inches is prepared in which a first Si layer 201 has a thickness of 100 μm, an insulating layer 202 has a thickness of 3 μm and a second Si layer 203 has a thickness of 200 μm.

Figure 3B:
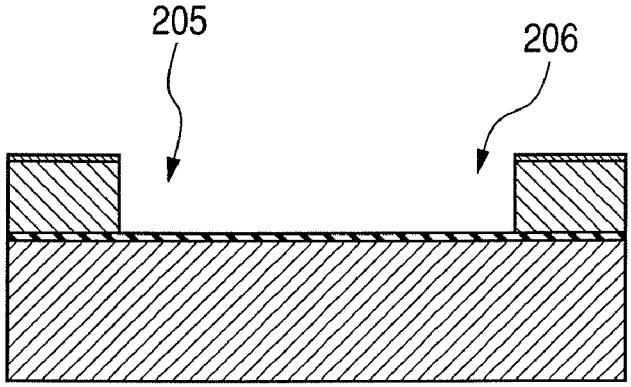

Subsequently, as shown in FIG. 3B, an etching mask is disposed on the first Si layer 201, and etching is performed from the side of the first Si layer 201 by use of the insulating layer 202 as an etching stop layer to form an individual liquid chamber 205 and a supply path 206 which communicates with the individual liquid chamber. During the etching, an ICP etching device known as a deep etching technology of Si is used. It is to be noted that FIG. 3B is a sectional view of the individual liquid chamber 205 viewed from a longitudinal direction.

Figure 3C:
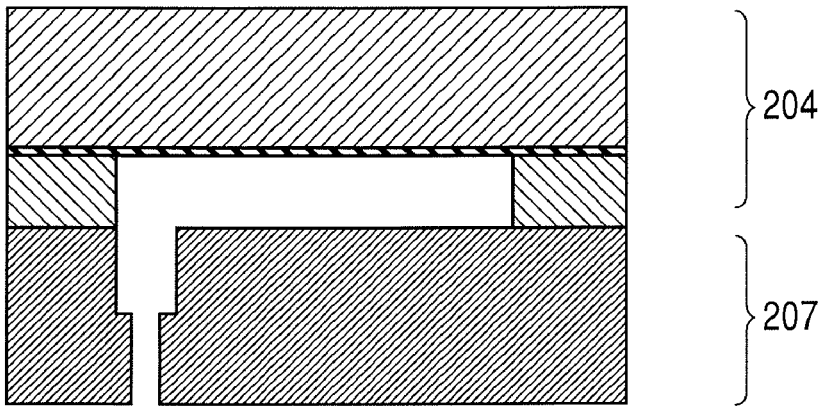

Subsequently, as shown in FIG. 3C, an SOI substrate 204 is bonded to an 200 μm thick orifice plate 207 made of Si and prepared separately from this SOI substrate by use of a direct bonding technology of Si. It is to be noted that a bonding method is not limited to this method, and a solid-phase bonding technology via an Au film may be used.

Figure 3D:
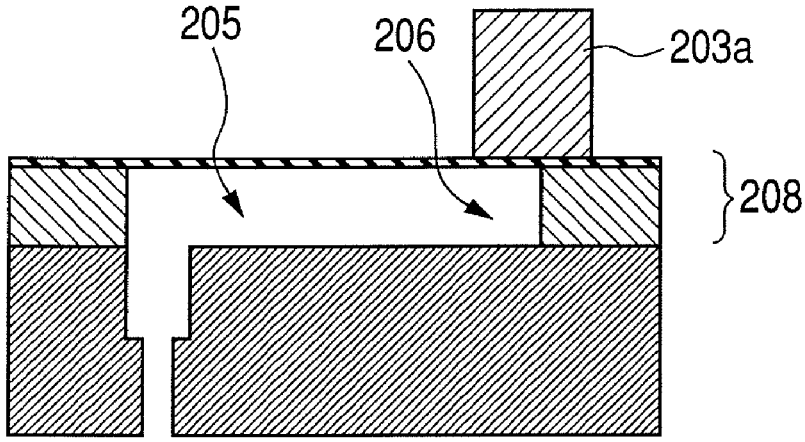

Subsequently, as shown in FIG. 3D, the second Si layer 203 is removed to constitute a channel substrate 208. In this case, a second Si layer 203*a* disposed above the supply path 206 is not removed. The second Si layer 203 disposed above a partition wall 209 (see FIG. 4) which separates the individual liquid chambers 205 from each other is removed. It is to be noted that the channel substrate 208 itself has a small thickness of about 100 μm. However, after the channel substrate is bonded to the orifice plate 207, the second Si layer 203 is removed. In consequence, the channel substrate 208 being treated during a manufacturing process might not crack.

Figure 3E:
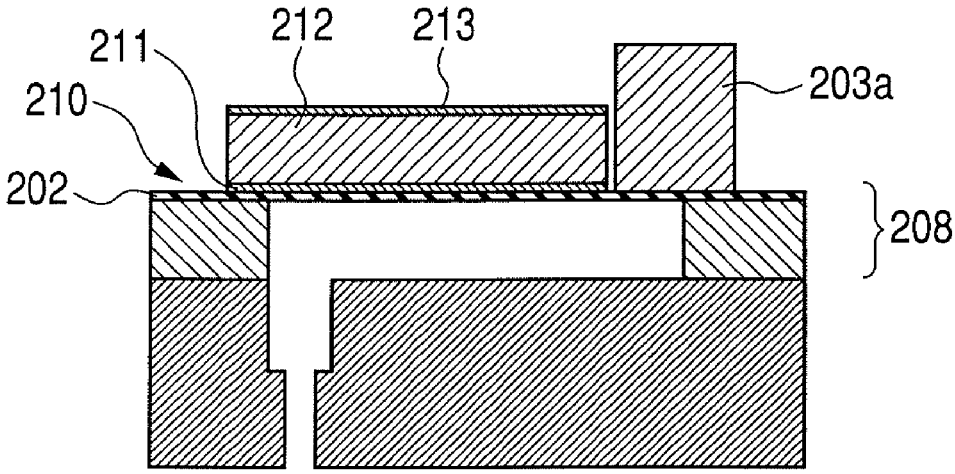

Afterward, as shown in FIG. 3E, the exposed insulating layer 202 is formed as a vibration plate 210, and a lower electrode 211, a piezoelectric thin film 212 and an upper electrode 213 are formed on the vibration plate 210. To form a piezoelectric thin film 212, first a bonded member of the channel substrate 208 and the orifice plate 207 is disposed in a sputtering device. Moreover, PZT is formed into a film having a thickness of 3 μm on the lower electrode 211 by a sputtering process. Afterward, the bonded material is removed from the sputtering device, and fired in an oxygen atmosphere to crystallize the PZT film. In consequence, the piezoelectric thin film 212 is formed. To obtain a satisfactory piezoelectric property of the piezoelectric thin film 212, a composition of the PZT thin film is adjusted into $Pb(Zr_{0.52}Ti_{0.48})O_3$. The composition of the PZT film is not necessarily limited to the above composition, and another composition may be constituted. The thickness of the PZT thin film is not limited to 3 μm.

Figure 4:
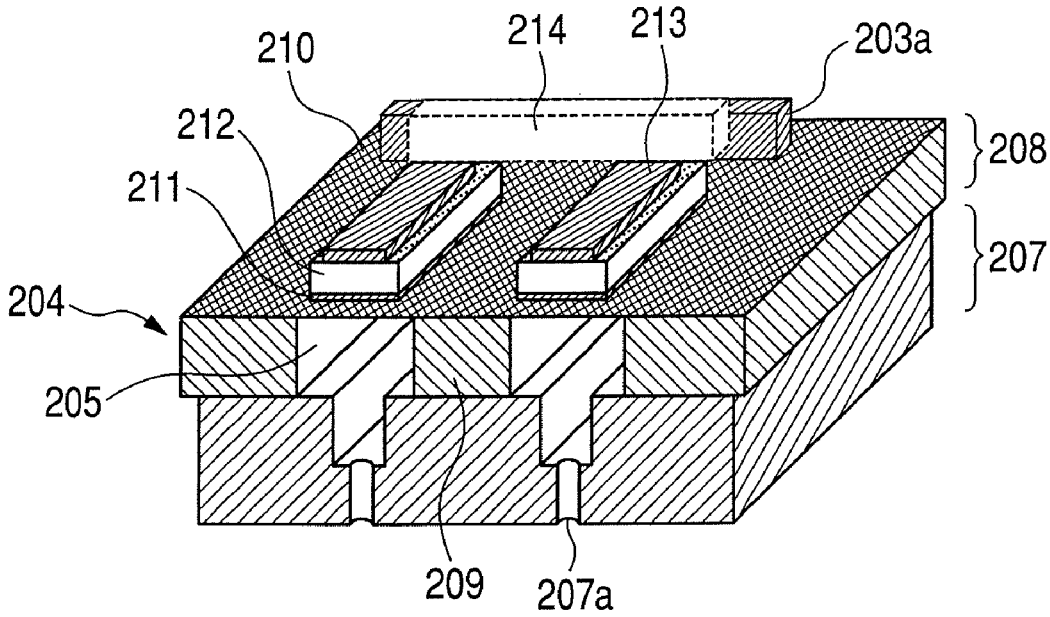
FIG. 4 is a perspective view schematically illustrating the ink jet head according to the second embodiment of the present invention.

Subsequently, the upper electrode 213 is formed on the piezoelectric thin film 212. Afterward, the upper electrode 213 and the piezoelectric thin film 212 are processed so as to correspond to each of the individual liquid chambers 205 by dry etching. Finally, a common liquid chamber 214 which communicates with the supply path 206 is formed in the second Si layer 203*a*. In consequence, the ink jet head is completed as shown in FIG. 4.

According to the ink jet head of the present embodiment constituted in this manner, when a voltage is applied between the lower electrode 211 and the upper electrode 213, the piezoelectric thin film 212 is deformed. When the piezoelectric thin film is deformed, the vibration plate 210 (see FIG. 3E) including the insulating layer 202 is deformed. In consequence, a liquid such as ink stored in the individual liquid chambers 205 which come in contact with the vibration plate 210 is pressurized, and discharged as liquid droplets from discharge ports 207*a* formed at the orifice plate 207.

It is to be noted that, in the present embodiment, the common liquid chamber 214 is formed at the second Si layer 203*a* having a thickness of 200 μm. However, after a thickness of the second Si layer 203*a* is reduced to, for example, about 100 μm, the common liquid chamber may be formed. Moreover, the second Si layer 203*a* is not necessarily formed only to form the common liquid chamber 214. For example, a lead electrode to be connected to the upper electrode 213 may be disposed on the second Si layer 203*a*, or the second Si layer 203*aa* may be used as a part of a sealing material for sealing of the piezoelectric thin film 212 from outside air.

In the present embodiment, the first Si layer 201 has a thickness of 100 μm, but the thickness of the first Si layer 201 is not limited to this dimension. A depth of each of the individual liquid chambers 205 can appropriately be selected by using the SOI substrate 204 including the first Si layer 201 having the thickness adapted to the desired depth of each of the individual liquid chambers 205.

Third Embodiment

Figure 5:
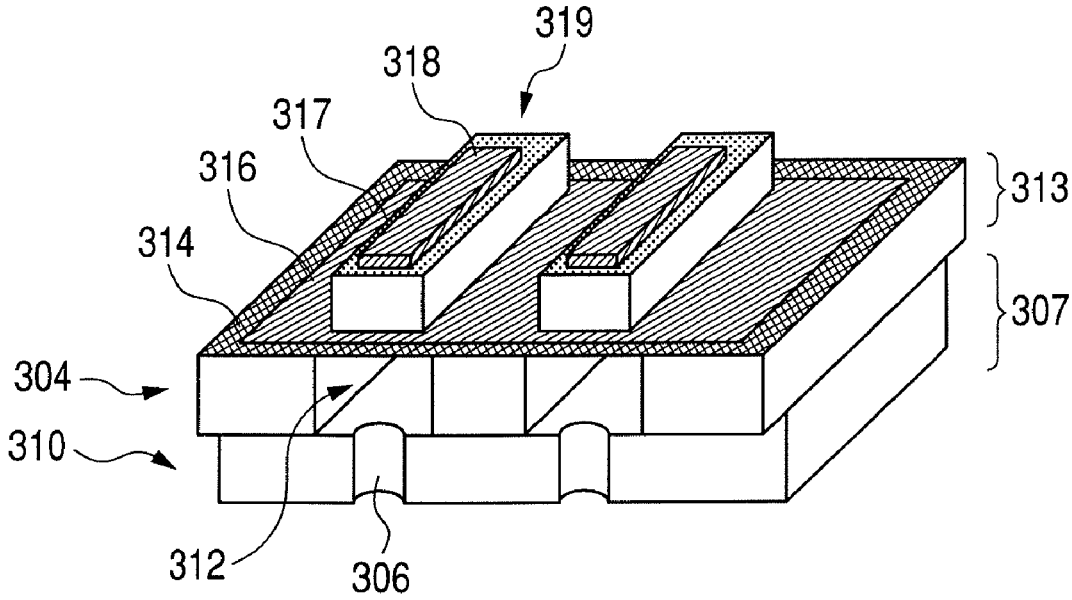
FIG. 5 is a perspective view schematically illustrating an ink jet head according to a third embodiment of the present invention.

FIG. 5 is a perspective view schematically illustrating an ink jet head according to a third embodiment of the present invention.

As shown in FIG. 5, an ink jet head of the present embodiment has a channel substrate 313 provided with a plurality of individual liquid chambers 312. The channel substrate 313 includes a part of a first SOI substrate 304. An $SiO_2$ layer 314 is formed on the surface of the first SOI substrate 304 forming the channel substrate 313, on which a first insulating layer 302 (see FIG. 6) is formed. Substantially on the whole surface of the $SiO_2$ layer, a lower electrode 316 is further formed. Furthermore, on a position of the lower electrode 316 which faces each of the individual liquid chambers 312, a piezoelectric thin film 317 having a shape extending along each of the individual liquid chambers 312 in a longitudinal direction is disposed. An upper electrode 318 is disposed on each piezoelectric thin film 317. These lower electrode 316, piezoelectric thin film 317 and upper electrode 318 constitute a piezoelectric element. An orifice plate 307 provided with discharge ports 306 is disposed on the other surface of the first SOI substrate 304 forming the channel substrate 313. The orifice plate 307 is constituted by a part of a second SOI substrate 310.

According to the ink jet head constituted in this manner, when a voltage is applied between the lower electrode 316 and the upper electrode 318, the piezoelectric thin film 317 is deformed. When the piezoelectric thin film is deformed, a vibration plate 315 (see FIG. 8A) including an $SiO_2$ layer 314 is deformed. A liquid such as ink stored in the individual liquid chambers 312 which come in contact with the vibration plate 315 is pressurized, and discharged as liquid droplets from the discharge ports 306 of the orifice plate 307.

Next, a manufacturing method of the ink jet head according to the present embodiment will be described with reference to FIGS. 6A to 8E.

Figure 6A:
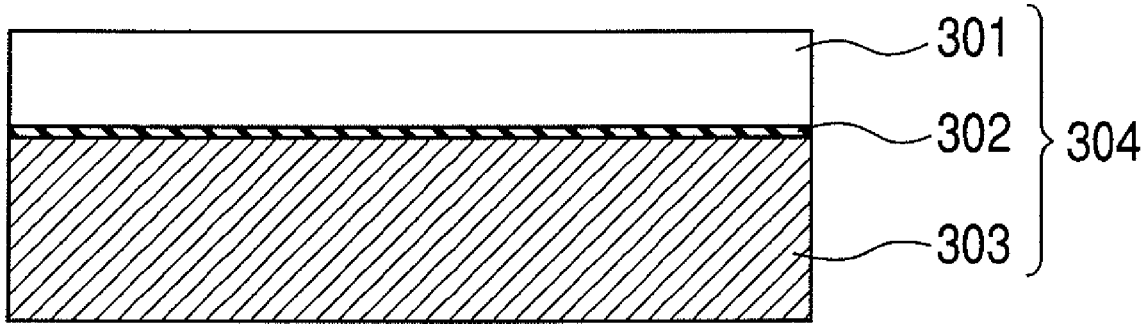
FIGS. 6A and 6B are diagrams illustrating a manufacturing method of the ink jet head according to the third embodiment of the present invention.

As shown in FIG. 6A, the first SOI substrate 304 having a size of six inches is prepared in which a first Si layer 301 has a thickness of 70 μm, the first insulating layer 302 has a thickness of 1 μm and a second Si layer 303 has a thickness of 200 μm.

Figure 6B:
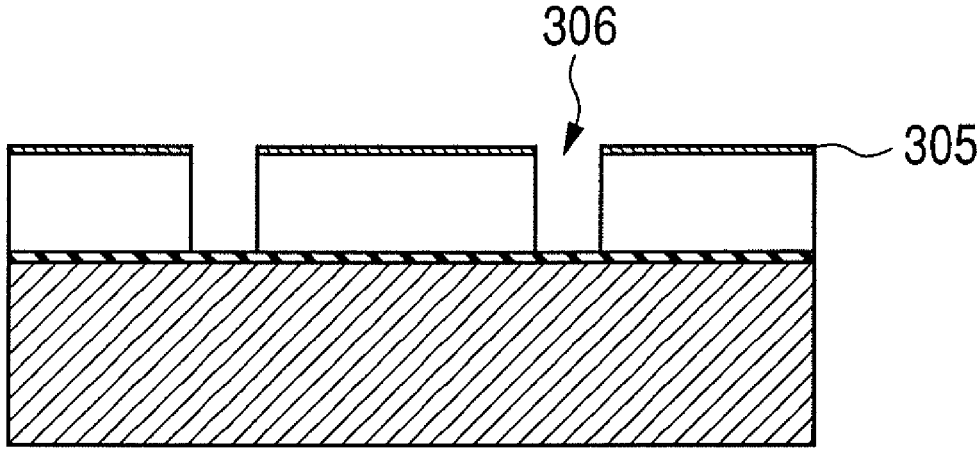

Subsequently, as shown in FIG. 6B, an etching mask 305 is disposed on the first Si layer 301, and etching is performed using the first insulating layer 302 as an etching stop layer to form the discharge ports 306. During the etching, an ICP etching device known as a deep etching technology of Si is used. In the present embodiment, the etching is performed using $CF_4$ and $SF_6$ as etching gases. It is to be noted that the etching mask 305 may be formed of a resist only, $SiO_2$ or SiON.

Figure 7A:
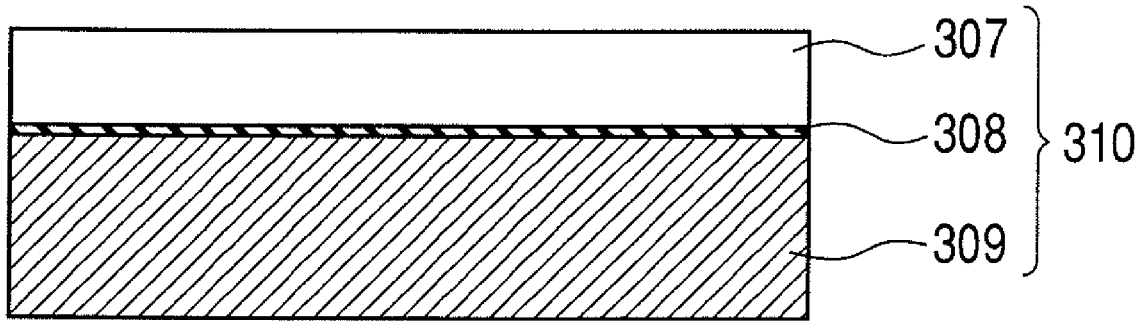
FIGS. 7A and 7B are diagrams illustrating a manufacturing method of the ink jet head according to the third embodiment of the present invention.

Subsequently, as shown in FIG. 7A, the second SOI substrate 310 having a size of six inches is prepared in which a third Si layer 307 has a thickness of 100 μm, a second insulating layer 308 has a thickness of 1 μm and a fourth Si layer 309 has a thickness of 200 μm.

Figure 7B:
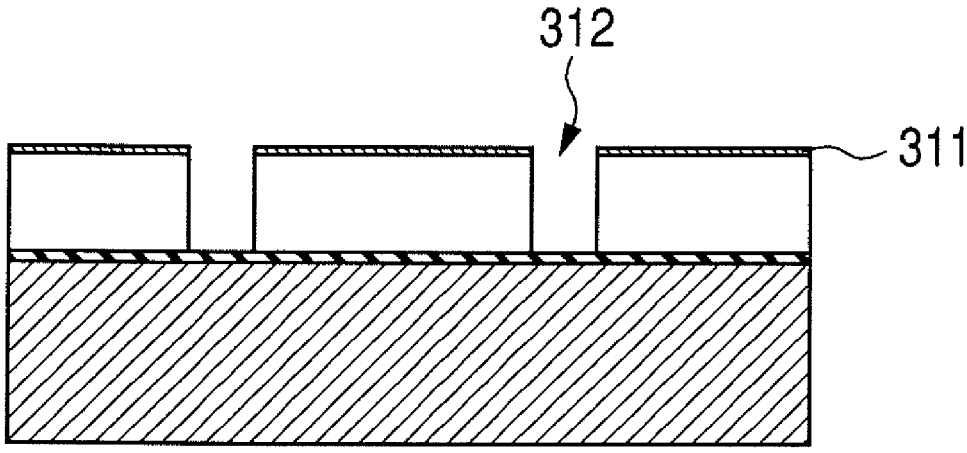

Subsequently, as shown in FIG. 7B, an etching mask 311 is disposed on the third Si layer 307, and the etching is performed using the second insulating layer 308 as an etching stop layer to form the individual liquid chambers 312. During the etching, an ICP etching device known as a deep etching technology of Si is used.

Figure 8A:
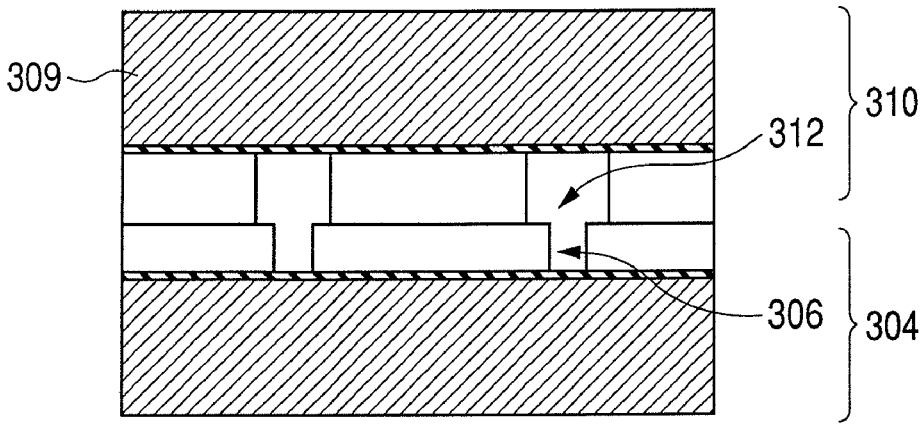
FIGS. 8A, 8B, 8C, 8D and 8E are diagrams illustrating a manufacturing method of the ink jet head according to the third embodiment of the present invention.

Subsequently, as shown in FIG. 8A, the first SOI substrate 304 provided with the discharge ports 306 is bonded to the second SOI substrate 310 provided with the individual liquid chambers 312 by use of a direct bonding technology of Si. In the present embodiment, the first SOI substrate 304 and the second SOI substrate 310 are both cleaned, and the Si layers 301 and 307 are attached to each other, then pressurized and bonded. It is to be noted that a bonding method is not limited to this method, and a solid-phase bonding technology via an Au film may be used.

Figure 8B:
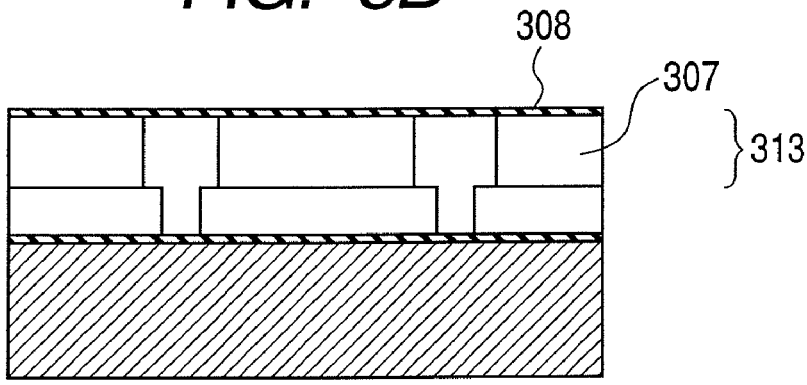

Subsequently, as shown in FIG. 8B, the fourth Si layer 309 of the second SOI substrate 310 is removed to constitute the channel substrate 313 including the third Si layer 307 and the second insulating layer 308 of the second SOI substrate 310. In the present embodiment, the fourth Si layer 309 having a thickness of 200 μm is removed from the whole surface by use of the ICP etching device. It is to be noted that a removing method of the fourth Si layer 309 is not limited to the above method, and the fourth Si layer may be removed by polishing.

The integrated channel substrate 313 and first SOI substrate 304 have a total thickness of about 300 μm in such a range that there is not any problem in treatment during a manufacturing process.

Figure 8C:
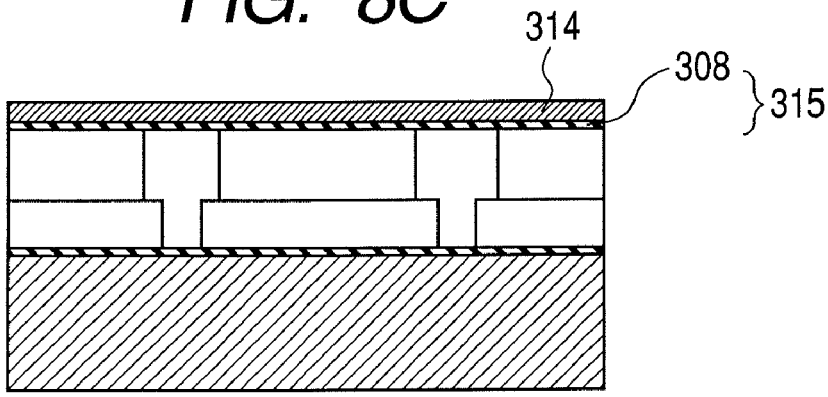

Subsequently, as shown in FIG. 8C, an $SiO_2$ layer 314 having a thickness of 3 μm is formed on the second insulating layer 308 to constitute the vibration plate 315 including the second insulating layer 308 and the $SiO_2$ layer 314. It is to be noted that the vibration plate 315 is not limited to this configuration, and may be constituted by the second insulating layer 308 only. Instead of the $SiO_2$ layer 314, an insulating film of SiON or SiN, or a metal film of Pt or Au may be formed, and this film and the second insulating layer 308 may constitute the vibration plate 315. When the insulating film or the metal film having desired thickness and Young's modulus is formed on the second insulating layer 308, the thickness and rigidity of the vibration plate 315 can freely be designed. The thickness of the vibration plate 315 is not limited to the above thickness, and may freely be designed in consideration of dimensions of the individual liquid chambers 312.

Figure 8D:
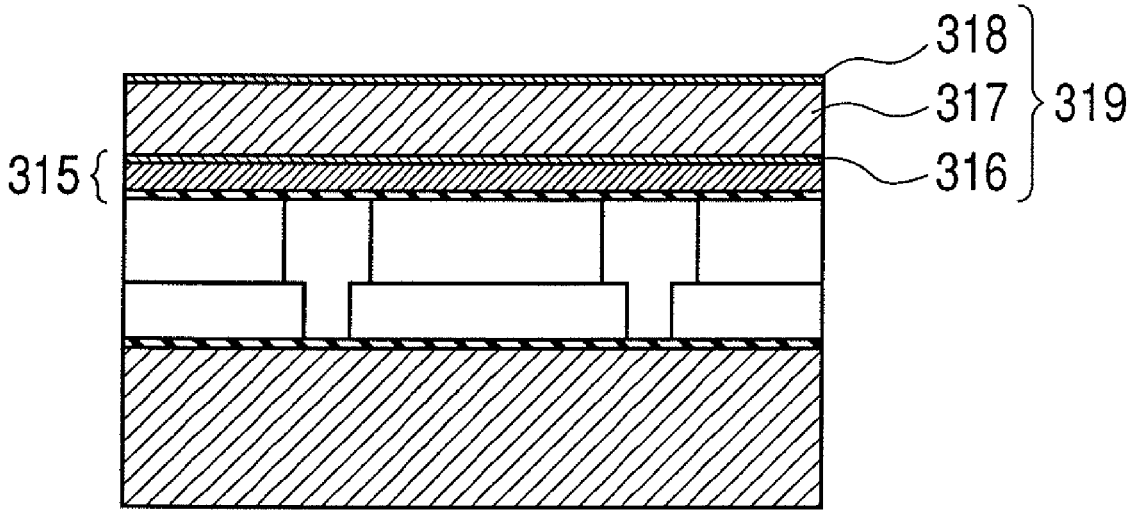

Subsequently, as shown in FIG. 8D, a piezoelectric element 319 including a lower electrode 316, a piezoelectric thin film 317 and an upper electrode 318 is formed on the vibration plate 315.

First, a film of Pt having a thickness of 300 nm is formed on the vibration plate 315 to form the lower electrode 316. When the piezoelectric thin film 317 is formed, first a bonded material of the first SOI substrate 304 and the second SOI substrate 310 is disposed in a sputtering device. Moreover, PZT is formed into a film having a thickness of 2.8 μm on the lower electrode 316 by a sputtering process. Afterward, the bonded material is removed from the sputtering device, and fired in an oxygen atmosphere to crystallize the PZT film. In consequence, the piezoelectric thin film 317 is formed. To obtain a satisfactory piezoelectric property of the piezoelectric thin film 317, a composition of the PZT thin film is adjusted into $Pb(Zr_{0.52}Ti_{0.48})O_3$. The composition of the PZT film is not necessarily limited to the above composition, and another composition may be constituted. The thickness of the PZT thin film is not limited to 2.8 μm. Afterward, a film of Pt having a thickness of 300 nm is formed on the piezoelectric thin film 317 to form the upper electrode 318.

Figure 8E:
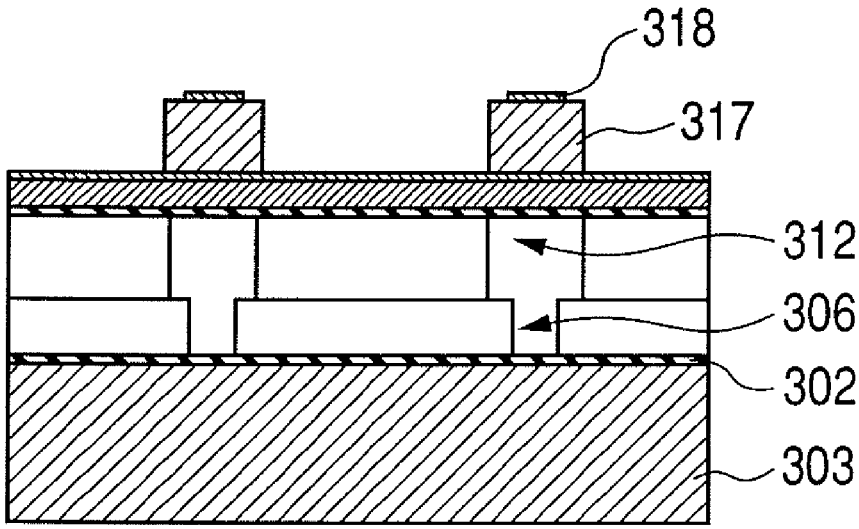

Subsequently, as shown in FIG. 8E, the upper electrode 318 and the piezoelectric thin film 317 are processed so as to correspond to each of the individual liquid chambers 312 by dry etching. In the present embodiment, the upper electrode 318 is etched using a boron chloride gas, and the piezoelectric thin film 317 is etched using a mixture gas of chlorine and fluorine.

Finally, when the second Si layer 303 and the first insulating layer 302 are removed by the etching, the ink jet head of the present embodiment is completed as shown in FIG. 5.

In the present embodiment, the second Si layer 303 is removed from the whole surface by the ICP etching device, and the first insulating layer 302 is then removed using the $CF_4$ gas. It is to be noted that the first insulating layer 302 does not necessarily have to be all removed. For example, after the second Si layer 303 is removed, portions of the first insulating layer 302 only corresponding to the discharge ports 306 may be removed.

Moreover, at least regions of the second Si layer 303 and the first insulating layer 302 corresponding to the discharge ports 306 may be removed, and another region may be left without being removed, or an only part of the other region in a thickness direction may be removed.

Furthermore, a removing method of the second Si layer 303 and the first insulating layer 302 is not limited to the above method, and polishing or wet etching by use of an alkaline solution may be used.

It is to be noted that the common liquid chamber 214 which supplies ink to the individual liquid chambers 312 may be formed at the same time when the individual liquid chambers 312 are formed at the third Si layer 307, or may be formed on the side of the first Si layer 301.

The thicknesses of the first Si layer 301 and the third Si layer 307 of the SOI substrates 304, 310 to be prepared may be set to desired depths of the discharge ports 306 and the individual liquid chambers 312 to form the discharge ports 306 and the individual liquid chambers 312. Therefore, the discharge ports 306 and the individual liquid chambers 312 having comparatively small thicknesses can be formed, and a liquid chamber having a degree of freedom adapted to a desired discharge performance can be designed.

Moreover, when the piezoelectric element 319 is constituted, the individual liquid chambers 312 and the discharge ports 306 are bonded and closed. Therefore, the piezoelectric element 319 can be prepared without allowing a liquid and foreign matters such as a resist and remover for use in constituting the piezoelectric element 319 to enter the individual liquid chambers and the discharge ports. Furthermore, since the second Si layer 303 and the first insulating layer 302 are finally removed, the surfaces of the discharge ports 306 do not come in contact with the etching device and are not polluted when formed.

It is to be noted that, in the present embodiment, the thickness of the first Si layer 301 is set to 70 μm, and the thickness of the third Si layer 307 is set to 100 μm, but the thicknesses of these Si layers 301, 307 are not limited to these dimensions. Since the first SOI substrate 304 including the first Si layer 301 having the thickness adapted to the desired depth of each of the discharge ports 306 is used, the depth of the discharge port 306 can appropriately be selected. Since the second SOI substrate 310 including the third Si layer 307 having the thickness adapted to the desired depth of each of the individual liquid chambers 312 is used, the depth of the individual liquid chamber 312 can appropriately be selected.

Fourth Embodiment

Next, a fourth embodiment of the present invention will be described with reference to FIGS. 9A, 9B. The fourth embodiment is similar to the third embodiment except in a forming method of a vibration plate. Therefore, only different respects will be described hereinafter.

Figure 9A:
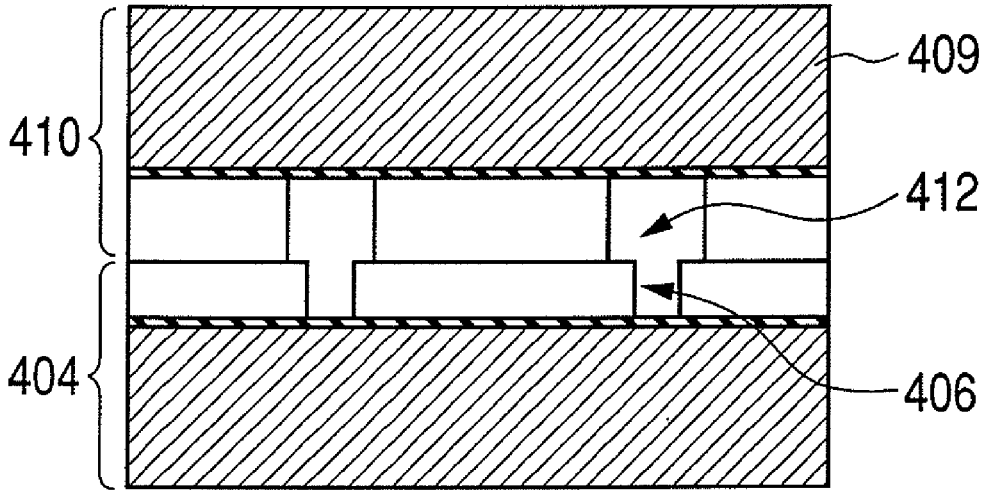
FIGS. 9A and 9B are diagrams illustrating a manufacturing method of the ink jet head according to a fourth embodiment of the present invention.

As shown in FIG. 9A, even in the present embodiment, Si layers of a first SOI substrate 404 provided with discharge ports 406 and a second SOI substrate 410 provided with individual liquid chambers 412 are bonded to each other.

Figure 9B:
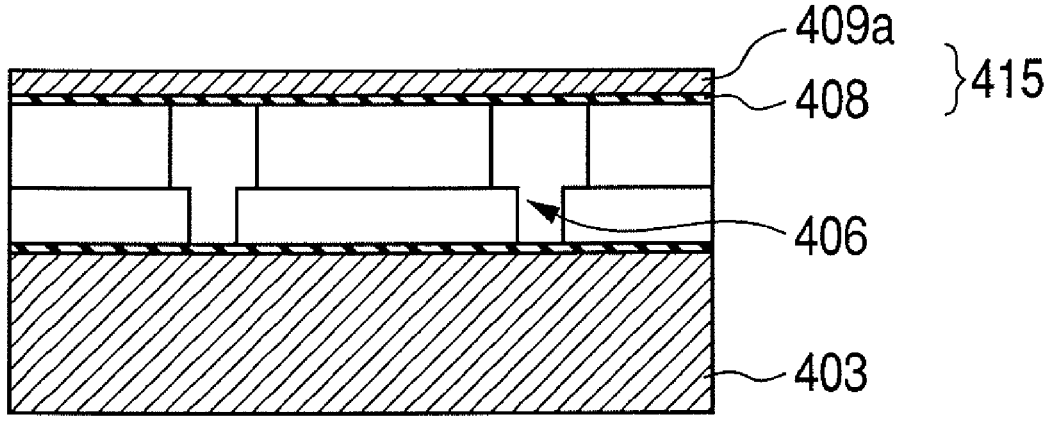

Subsequently, as shown in FIG. 9B, a fourth Si layer 409 of the second SOI substrate 410 is thinned by polishing. In the present embodiment, the fourth Si layer 409 having a thickness of 200 μm is polished as much as 196 μm, and the fourth Si layer having a thickness of 4 μm is left on a second insulating layer 408 without being polished. In consequence, the second insulating layer 408 and a fourth Si layer 409*a* having the thickness of 4 μm function as a vibration plate 415. The vibration plate 415 including the second insulating layer 408 made of $SiO_2$ and the fourth Si layer 409 made of Si has high rigidity, and can be provided with a sufficient function so as to obtain a desired discharge performance.

Moreover, during polishing, the fourth Si layer 409 is mechanically polished, so that an amount of the layer to be polished has a good in-plane uniformity, and the layer can highly precisely be polished. It is to be noted that during the polishing, an opposite surface (a second Si layer 403) of the fourth Si layer 409 comes in contact with a jig of a polishing device, but the jig does not directly come in contact with the discharge ports 406 and does not pollute the discharge ports 406.

It is to be noted that, in the present embodiment, the thickness of the fourth Si layer 409*a* forming a part of the vibration plate 415 is set to 4 μm, but is not limited to this dimension.

Subsequently, a piezoelectric element is constituted in the same manner as in the third embodiment, thereby preparing an ink jet head.

Even according to such a manufacturing method of the fourth embodiment, effects similar to those of the third embodiment can be obtained.

Fifth Embodiment

Next, a fifth embodiment of the present invention will be described with reference to FIGS. 10A to 10C. The fifth embodiment is similar to the third embodiment except in a process of removing a fourth Si layer 509. Therefore, only different respects will be described hereinafter.

Figure 10A:
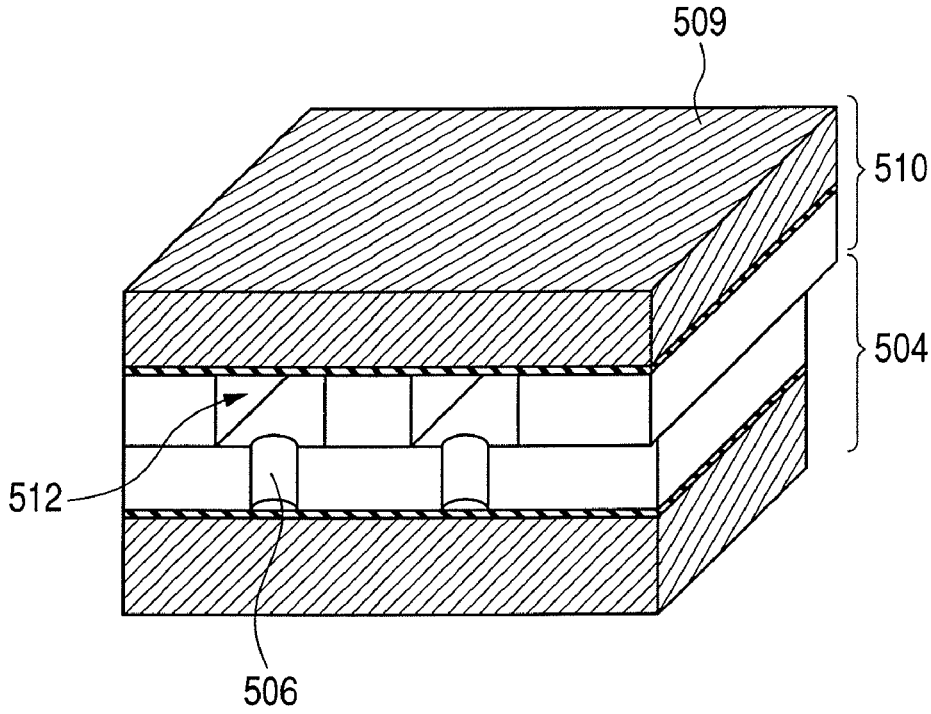
FIGS. 10A, 10B and 10C are diagrams illustrating a manufacturing method of the ink jet head according to a fifth embodiment of the present invention.

As shown in FIG. 10A, even in the present embodiment, Si layers of a first SOI substrate 504 provided with discharge ports 506 and a second SOI substrate 510 provided with individual liquid chambers 512 are bonded to each other.

Figure 10B:
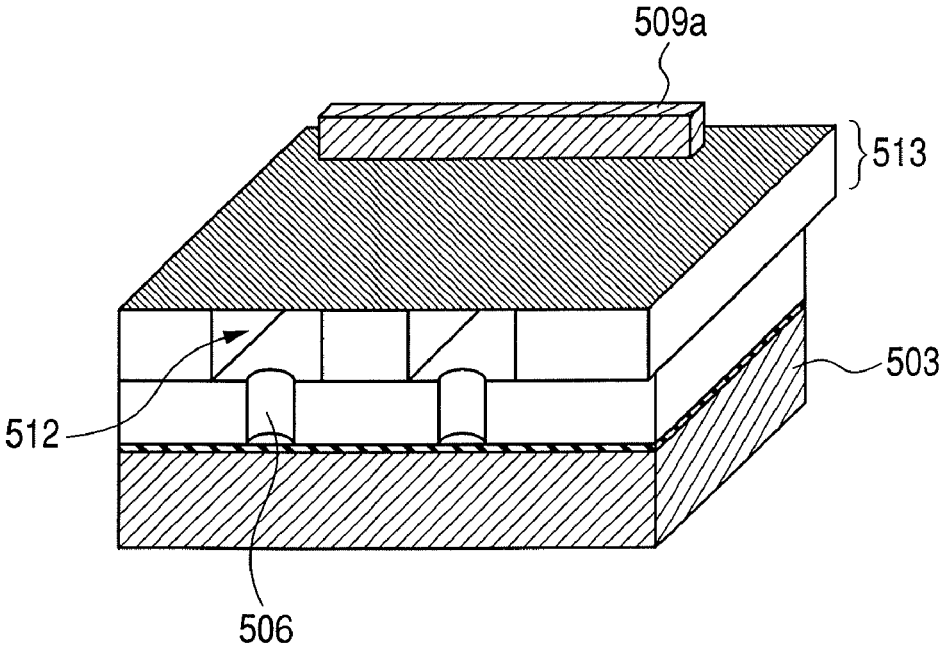

Subsequently, as shown in FIG. 10B, at least portions of the fourth Si layer 509 positioned above the individual liquid chambers 512 are completely removed, and the other portions are not removed and are left to dispose a fourth Si layer 509*a*. A removing method of the fourth Si layer 509 may be dry etching by use of ICP or wet etching by use of an alkali solution. The fourth Si layer 509*a* may partially be etched in a thickness direction to provide a thickness of, for example, about 100 μm.

Figure 10C:
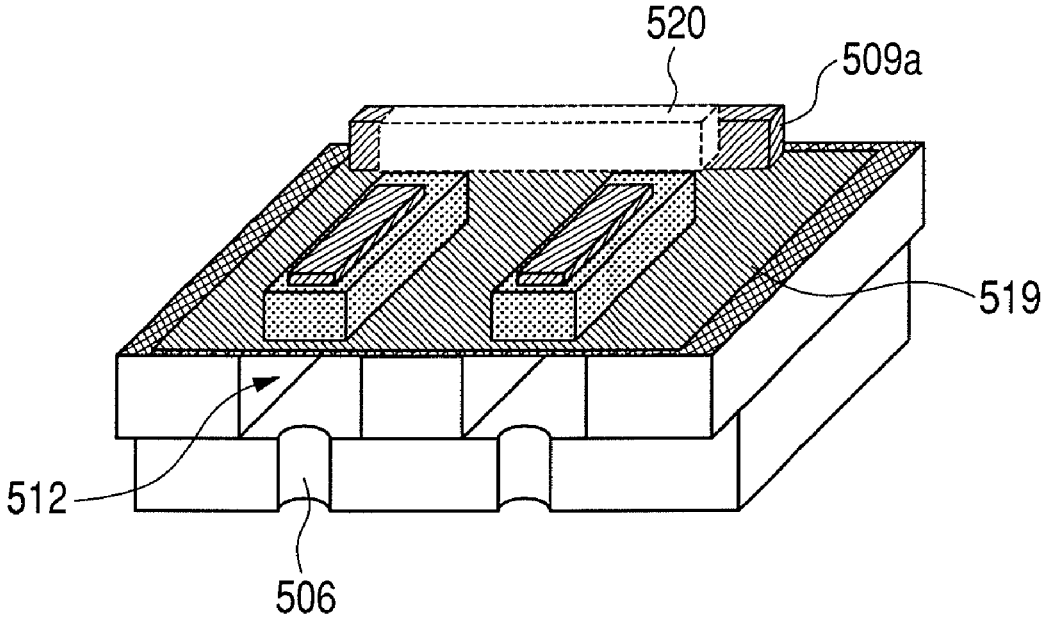

Afterward, as shown in FIG. 10C, a piezoelectric element 519 is constituted, and a second Si layer 503 is removed. Finally, the fourth Si layer 509*a* is provided with a common liquid chamber 520 which communicates with the individual liquid chambers 512. In consequence, an ink jet head is completed.

It is to be noted that the fourth Si layer 509*a* is not necessarily formed only to form the common liquid chamber 512. For example, a lead electrode to be connected to an upper electrode of the piezoelectric element 519 may be disposed on the fourth Si layer 509*a*, or the fourth Si layer may be used as a part of a sealing material for sealing of the piezoelectric element 519 from outside air. A region of the fourth Si layer 509 at a portion thereof other than the portion thereof positioned above the individual liquid chambers 512 is not removed and is partially left. In this case, the common liquid chamber 520 can freely be formed.

Even according to such a manufacturing method of the fifth embodiment, effects similar to those of the third embodiment can be obtained.

Sixth Embodiment

Figure 11:
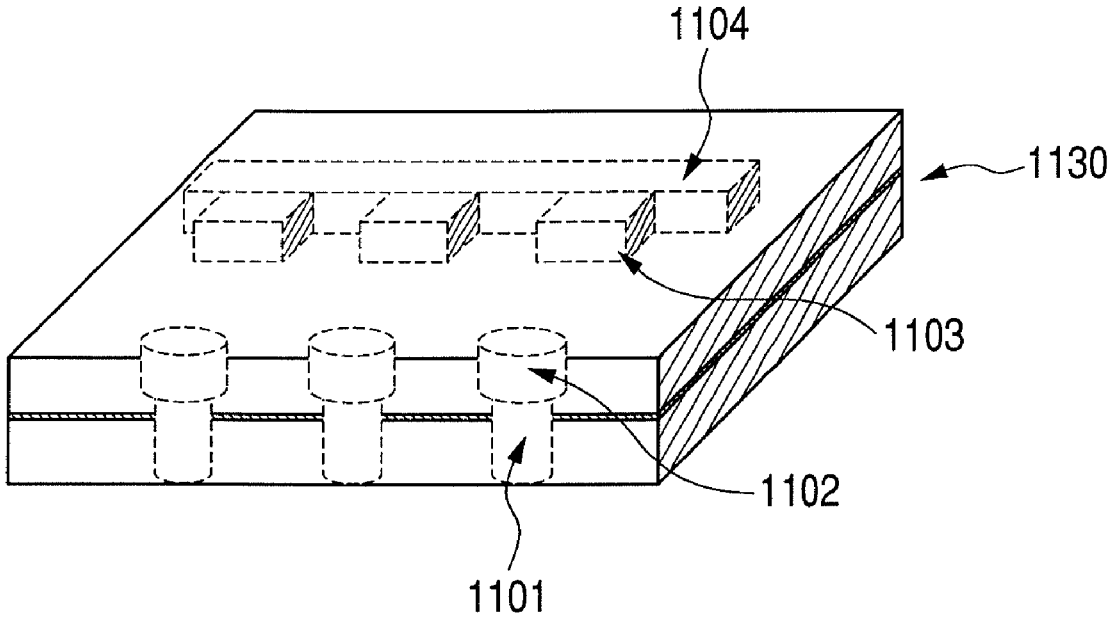
FIG. 11 is a see-through perspective view schematically illustrating an orifice plate according to a sixth embodiment of the present invention.
Figure 12:
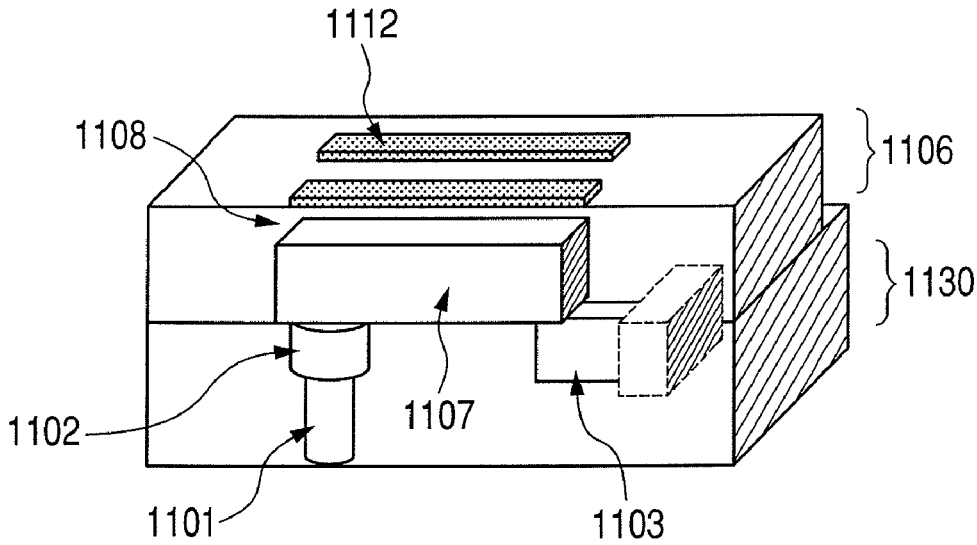
FIG. 12 is a see-through perspective view schematically illustrating an ink jet head constituted by attaching a channel substrate to the orifice plate shown in FIG. 11.

FIG. 11 is a see-through perspective view schematically illustrating an orifice plate according to a sixth embodiment of the present invention. FIG. 12 is a see-through perspective view schematically illustrating an ink jet head constituted by attaching a channel substrate to the orifice plate shown in FIG. 11.

As shown in FIG. 11, an orifice plate 1130 of the present embodiment is provided with a plurality of discharge ports 1101, communication portions 1102, supply ports 1103 and a common liquid chamber 1104.

As shown in FIG. 12, the supply ports 1103 and the communication portions 1102 communicate with individual liquid chambers 1107 formed in a channel substrate 1106 prepared separately from the orifice plate 1130. The channel substrate 1106 is positioned above the individual liquid chambers 1107, and has a vibration plate 1108 forming one surface of the individual liquid chambers 1107. An actuator 1112 including a lower electrode, a piezoelectric thin film and an upper electrode is disposed on the vibration plate 1108. According to the ink jet head constituted in this manner, when power is supplied to the actuator 1112, the vibration plate 1108 is deformed. In consequence, a liquid such as ink stored in the individual liquid chambers 1107 which come in contact with the vibration plate 1108 is pressurized, and discharged as liquid droplets from the discharge ports 1101 via the communication portions 1102. The supply ports 1103 perform a function of a channel resistance at a time when the liquid droplets are discharged.

Next, a manufacturing method of the ink jet head according to the present embodiment will be described with reference to FIGS. 13A to 15C.

Figure 13A:
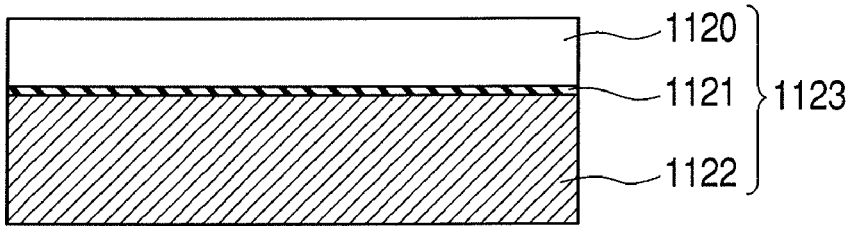
FIGS. 13A and 13B are diagrams illustrating a manufacturing method of an orifice plate according to a sixth embodiment of the present invention.

First, as shown in FIG. 13A, a first SOI substrate 1123 having a size of six inches is prepared in which a first Si layer 1120 has a thickness of 30 μm, a first insulating layer 1121 has a thickness of 1 μm and a second Si layer 1122 has a thickness of 150 μm.

Figure 13B:
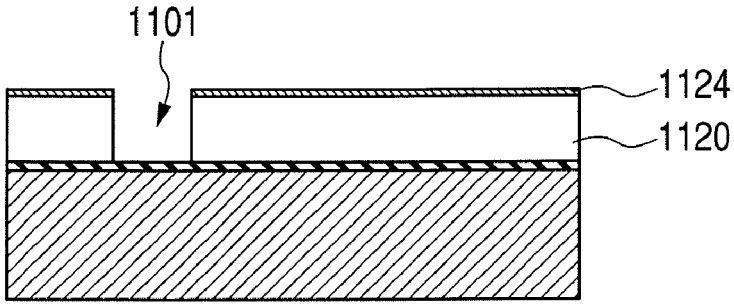

Subsequently, as shown in FIG. 13B, an etching mask 1124 is disposed on the side of the first Si layer 1120, and etching is performed using the first insulating layer 1121 as an etching stop layer to form the discharge ports 1101. In the present embodiment, each of the discharge ports 1101 is formed into a circular shape having a diameter of 15 μm. During the etching, an ICP etching device known as a deep etching technology of Si is used. In the present embodiment, the etching is performed using $CF_4$ and $SF_6$ as etching gases.

Subsequently, the communication portions 1102, the supply ports 1103 and the common liquid chamber 1104 are processed.

Figure 14A:
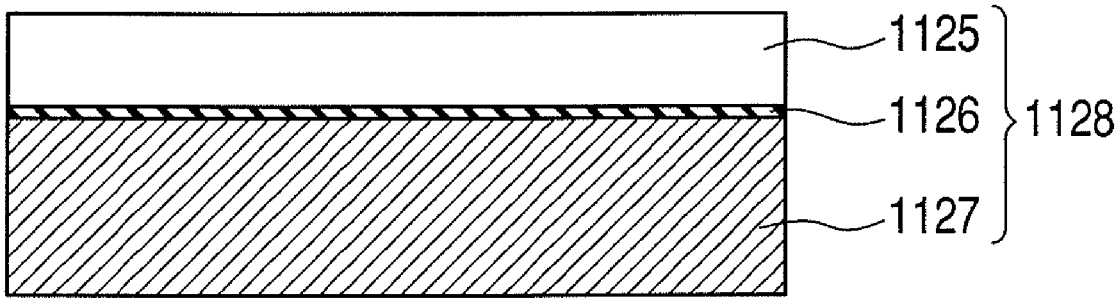
FIGS. 14A and 14B are diagrams illustrating a manufacturing method of the orifice plate according to the sixth embodiment of the present invention.

First, as shown in FIG. 14A, a second SOI substrate 1128 having a size of six inches is prepared in which a third Si layer 1125 has a thickness of 50 μm, a second insulating layer 1126 has a thickness of 1 μm and a fourth Si layer 1127 has a thickness of 150 μm.

Figure 14B:
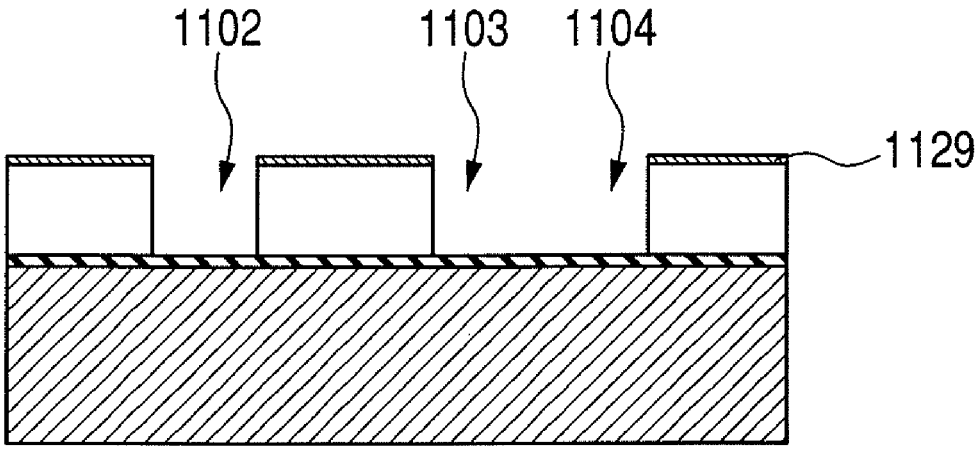

Subsequently, as shown in FIG. 14B, an etching mask 1129 is disposed on the side of the third Si layer 1125, and etching is performed using the second insulating layer 1126 as an etching stop layer to form the communication portions 1102, the supply ports 1103 and the common liquid chamber 1104. In the present embodiment, each of the communication portions 1102 is formed into a circular shape having a diameter of 30 μm. Each of the supply ports 1103 is formed into a shape having a width of 30 μm and a length of 200 μm. During the etching, the ICP etching device known as the deep etching technology of Si is used.

It is to be noted that the supply ports 1103 and the common liquid chamber 1104 do not have to be necessarily formed at the third Si layer 1125, and may be formed on the side of a channel substrate described later. In the present embodiment, the discharge ports 1101, the communication portions 1102 and the supply ports 1103 are formed by the ICP etching, but means for forming these ports and portions do not have to be necessarily limited to this method, and anisotropic etching of Si by use of an alkali solution may be performed. The etching masks 1124, 1129 may be formed of a resist or may be made of $SiO_2$ or SiON.

Subsequently, the etching masks 1124, 1129 are removed from the first and third Si layers 1120, 1125.

Figure 15A:
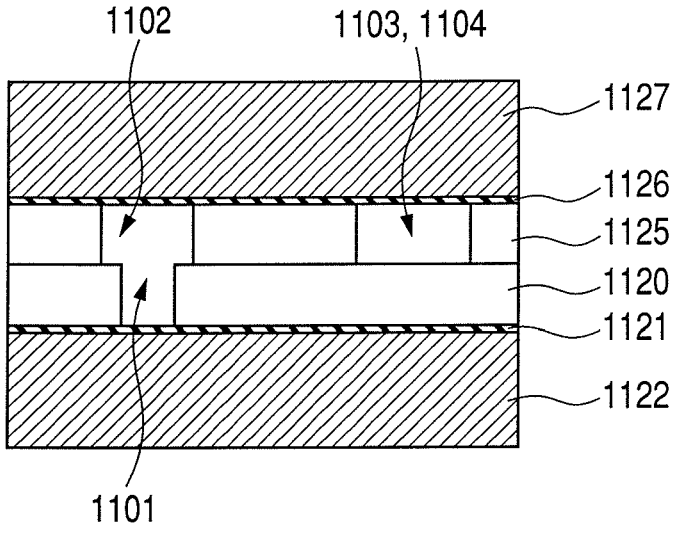
FIGS. 15A, 15B and 15C are diagrams illustrating a manufacturing method of the orifice plate according to the sixth embodiment of the present invention.

Subsequently, as shown in FIG. 15A, the first Si layer 1120 of the first SOI substrate 1123 and the third Si layer 1125 of the second SOI substrate 1128 are attached and bonded to each other so that the discharge ports 1101 communicate with the communication portions 1102. During the bonding, a direct bonding technology of Si may be used. Alternatively, a solid-phase bonding technology via an Au film formed on the surface of the Si layer may be used.

Figure 15B:
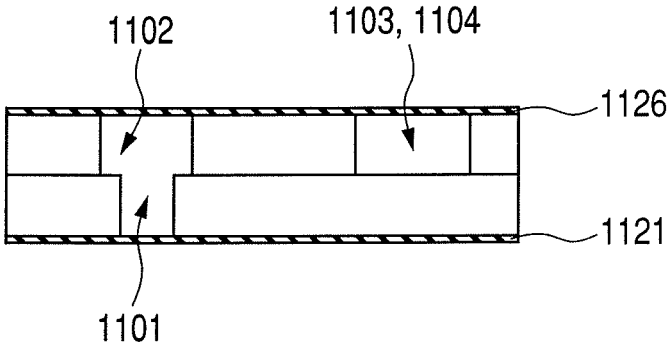

Subsequently, as shown in FIG. 15B, the second Si layer 1122 of the first SOI substrate 1123 and the fourth Si layer 1127 of the second SOI substrate 1128 are removed by dry etching by use of ICP or polishing.

Figure 15C:
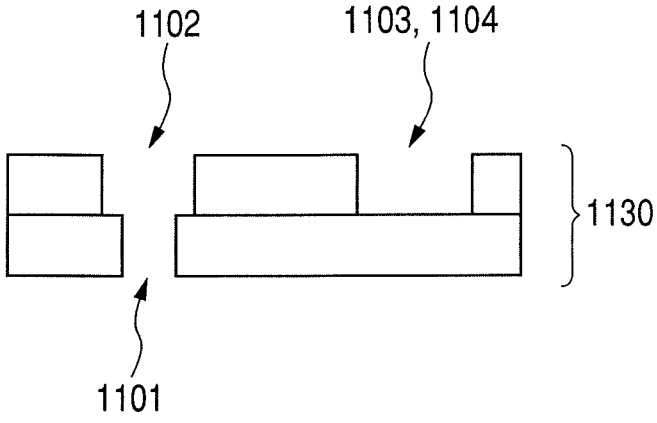

Finally, as shown in FIG. 15C, the first insulating layer 1121 of the first SOI substrate 1123 and the second insulating layer 1126 of the second SOI substrate 1128 are etched with a buffered hydrofluoric acid solution to prepare the orifice plate 1130. It is to be noted that the first and second insulating layers 1121, 1126 do not have to be necessarily removed by the etching, and may be left without being removed as the case may be.

Subsequently, the orifice plate 1130, the actuator 1112 and the channel substrate 1106 provided with the vibration plate 1108, and the individual liquid chambers 1107 are bonded to prepare the ink jet head (see FIG. 12).

A depth of each of the discharge ports 1101 can be set to a desired depth in accordance with the thickness of the first Si layer 1120 of the first SOI substrate 1123 to be prepared, and a diameter of the discharge port 1101 can freely be designed within a plane of the first Si layer 1120. The discharge ports 1101 are formed at the first SOI substrate 1123 which is the SOI substrate separate from the second SOI substrate 1128 provided with the communication portions 1102 and the supply ports 1103. Therefore, the discharge ports 1101 can be designed independently of dimensions of the communication portions 1102 and the supply ports 1103. Therefore, the discharge ports 1101 which influence a liquid droplet discharge performance can freely and highly precisely be formed in accordance with a desired discharge performance.

Similarly, the depths of the communication portions 1102 and the supply ports 1103 can be set to desired depths in accordance with the thickness of the third Si layer 1125 of the second SOI substrate 1128 to be prepared. Diameters, widths and lengths of the communication portions 1102 and the supply ports 1103 can freely be designed within a plane of the third Si layer 1125.

It is to be noted that, in the present embodiment, as the first SOI substrate 1123, a substrate having a size of six inches is used in which the first Si layer 1120 has a thickness of 30 μm, the first insulating layer 1121 has a thickness of 1 μm and the second Si layer 1122 has a thickness of 150 μm. However, a size of the first SOI substrate 1123 is not limited to this size, and the size of the first SOI substrate 1123 may be determined in accordance with a desired dimension of each discharge port 1101. Similarly, the size of the second SOI substrate 1128 can be determined in accordance with desired dimensions of the communication portions 1102 and the supply ports 1103. The dimensions of the discharge ports 1101, the communication portions 1102 and the supply ports 1103 are not limited to the above dimensions, and can appropriately be changed as desired.

Seventh Embodiment

Next, an orifice plate and an ink jet head including the orifice plate according to a seventh embodiment of the present invention will be described.

FIGS. 16A to 16E are diagrams illustrating a manufacturing method of the orifice plate and the ink jet head including the orifice plate according to the seventh embodiment of the present invention. The present embodiment is similar to the sixth embodiment except that a second Si layer 1122 of a first SOI substrate 1123 is removed after an orifice plate 1130 is bonded to a channel substrate 1106. Therefore, constitutions of discharge ports 1101, communication portions 1102, supply ports 1103 and a common liquid chamber 1104 are similar to those of the sixth embodiment (see FIGS. 13A to 15C). In FIGS. 16A to 16E, the same reference numerals as those of the sixth embodiment are used.

A manufacturing method of an ink jet head according to the present embodiment will be described.

Figure 16A:
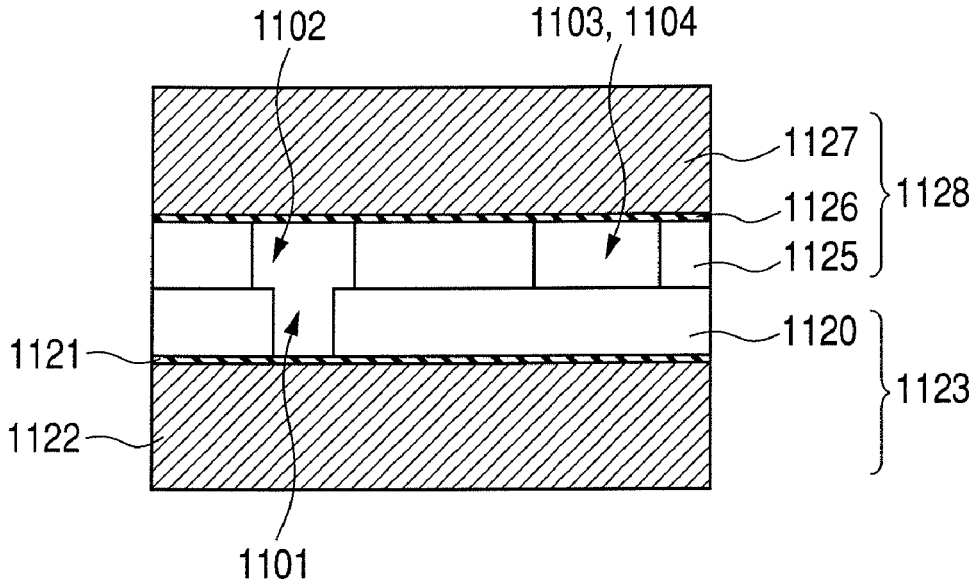
FIGS. 16A, 16B, 16C, 16D and 16E are diagrams illustrating a manufacturing method of an orifice plate and an ink jet head according to a seventh embodiment of the present invention.

As shown in FIG. 16A, a first Si layer 1120 of the first SOI substrate 1123 is attached and bonded to a third Si layer 1125 of a second SOI substrate 1128 so that the discharge ports 1101 communicate with the communication portions 1102. During the bonding, a direct bonding technology of Si may be used.

Alternatively, a solid-phase bonding technology via an Au film formed on the surface of the Si layer may be used.

Figure 16B:
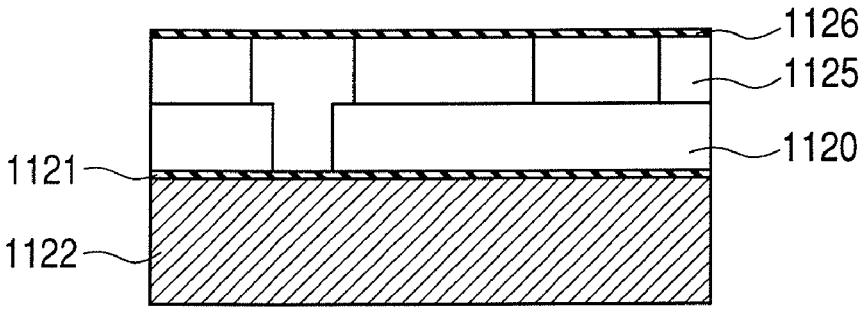

Subsequently, as shown in FIG. 16B, a fourth Si layer 1127 of the second SOI substrate 1128 is removed by dry etching by use of ICP or polishing.

Figure 16C:
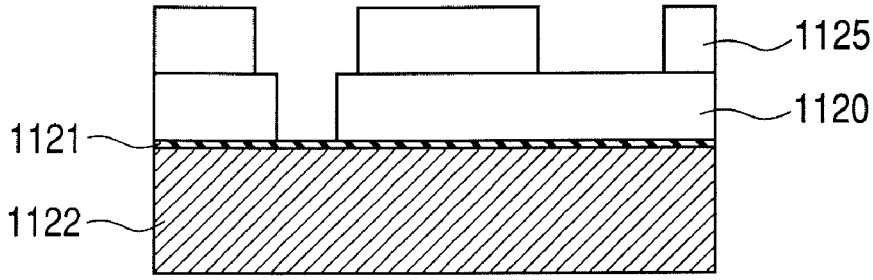

Subsequently, as shown in FIG. 16C, a second insulating layer 1126 of the second SOI substrate 1128 is removed with a buffered hydrofluoric acid solution.

Figure 16D:
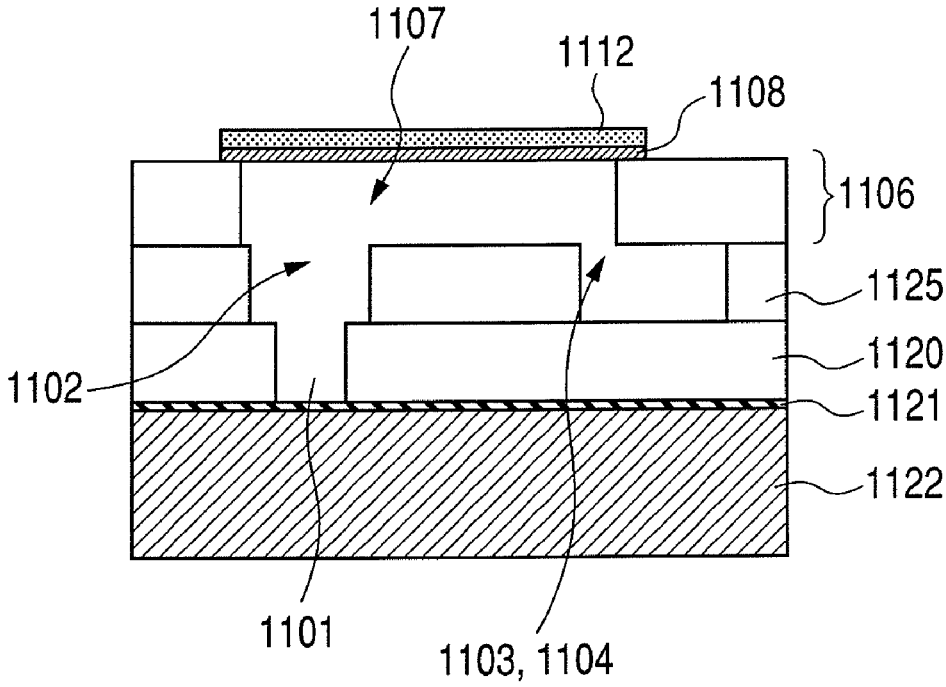

Afterward, as shown in FIG. 16D, the channel substrate 1106 is bonded to the third Si layer 1125 by a direct bonding technology of Si or a solid-phase bonding technology of Au. The channel substrate is provided with individual liquid chambers 1107 which allow the communication portions 1102 to communicate with the supply ports 1103 formed at the third Si layer 1125. It is to be noted that an actuator 1112 and a vibration plate 1108 may be formed at the channel substrate 1106 beforehand. Alternatively, the actuator and the vibration plate may be formed at the channel substrate 1106 by a film formation process or a transfer process after the channel substrate is bonded to the third Si layer as described above.

Figure 16E:
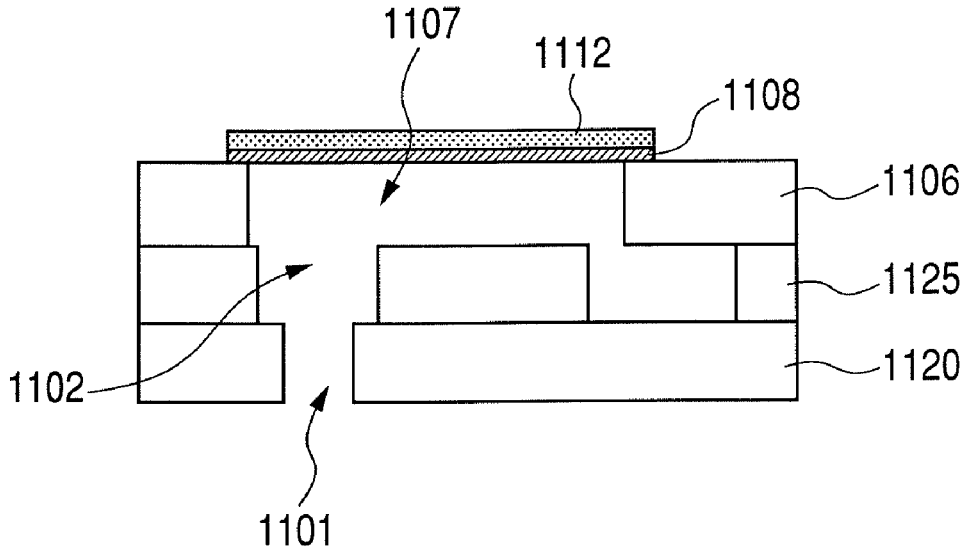

Finally, as shown in FIG. 16E, the second Si layer 1122 and a first insulating layer 1121 of the first SOI substrate 1123 are removed by polishing or wet etching to prepare the ink jet head. It is to be noted that the first insulating layer 1121 does not have to be necessarily removed by the etching, and may be left without being removed as the case may be.

Even in the present embodiment, the discharge ports 1101, the communication portions 1102 and the supply ports 1103 forming a channel resistance can freely and highly precisely be formed in accordance with desired discharge performances thereof. Moreover, after the channel substrate 1106 is bonded to the third Si layer 1125, the second Si layer 1122 of the first SOI substrate 1123 is removed. In consequence, the surfaces of the discharge ports 1101 are not polluted with a chuck (not shown) which grasps the ink jet head to be prepared. Furthermore, even if the discharge ports 1101, the communication portions 1102 and the individual liquid chambers 1107 are to be formed to be shallow, the ink jet head is remarkably easily handled when prepared. This is because the second Si layer 1122 is disposed.

Even according to such a constitution and manufacturing method of the seventh embodiment, effects similar to those of the sixth embodiment can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-271923, filed Oct. 3, 2006, and No. 2007-078904, filed Mar. 26, 2007 which are hereby incorporated by reference herein in their entirety.

What is claimed is:

1. A manufacturing method of a liquid discharge head having a liquid chamber which communicates with a discharge port for discharging a liquid, the method comprising:

etching a first Si layer of an SOI substrate by use of an insulating layer as an etching stop layer to form the liquid chamber at the first Si layer, the SOI substrate being constituted by the first Si layer, the insulating layer and a second Si layer layered in this order;

removing a part or all of the second Si layer; and joining the first Si layer to an orifice plate provided with the discharge port, after forming the liquid chamber and before removing the second Si layer.

2. The manufacturing method of the liquid discharge head according to claim 1, wherein the SOI substrate in which the first Si layer is thinner than the second Si layer is used.

3. The manufacturing method of the liquid discharge head according to claim 1, wherein when joining the first Si layer to the orifice plate, the first Si layer is joined to the orifice plate by one of direct joining and solid-phase joining via a metal film.

4. A manufacturing method of a liquid discharge head having a liquid chamber which communicates with a discharge port for discharging a liquid, the method comprising:

etching a first Si layer of an SOI substrate by use of an insulating layer as an etching stop layer to form the liquid chamber at the first Si layer, the SOI substrate being constituted by the first Si layer, the insulating layer and a second Si layer layered in this order;

removing a part or all of the second Si layer; and forming, on the insulating layer, a piezoelectric element which generates energy to discharge the liquid from the discharge port, after removing the second Si layer.

5. A manufacturing method of a liquid discharge head having a liquid chamber which communicates with a discharge port for discharging a liquid, the method comprising:

etching a first Si layer of a first SOI substrate by use of a first insulating layer as an etching stop layer to form the discharge port at the first Si layer, the first SOI substrate being constituted by the first Si layer, the first insulating layer and a second Si layer layered in this order;

etching a third Si layer of a second SOI substrate by use of a second insulating layer as an etching stop layer to form the liquid chamber at the third Si layer, the second SOI substrate being constituted by the third Si layer, the second insulating layer and a fourth Si layer layered in this order;

joining the first Si layer to the third Si layer so that the discharge ports communicate with the liquid chamber; and after joining the first Si layer to the third Si layer, removing a part or all of the fourth Si layer; and forming, on the second insulating layer, a piezoelectric element which generates energy to discharge the liquid from the discharge ports.

6. A manufacturing method of a liquid discharge head having a liquid chamber which communicates with a discharge port for discharging a liquid, the method comprising:

etching a first Si layer of a first SOI substrate by use of a first insulating layer as an etching stop layer to form the discharge port at the first Si layer, the first SOI substrate being constituted by the first Si layer, the first insulating layer and a second Si layer layered in this order;

etching a third Si layer of a second SOI substrate by use of a second insulating layer as an etching stop layer to form the liquid chamber at the third Si layer, the second SOI substrate being constituted by the third Si layer, the second insulating layer and a fourth Si layer layered in this order; and joining the first Si layer to the third Si layer so that the discharge ports communicate with the liquid chamber, wherein when joining the first Si layer to the third Si layer, the first Si layer is joined to the third Si layer by one of direct joining and solid-phase joining via a metal film.

7. A manufacturing method of an orifice plate having a discharge port for discharging a liquid and a communication portion which communicates with the discharge port, the method comprising:

etching a first Si layer of a first SOI substrate by use of a first insulating layer as an etching stop layer to form the discharge port at the first Si layer, the first SOI substrate being constituted by the first Si layer, the first insulating layer and a second Si layer layered in this order;

etching a third Si layer of a second SOI substrate by use of a second insulating layer as an etching stop layer to form the communication portion at the third Si layer, the second SOI substrate being constituted by the third Si layer, the second insulating layer and a fourth Si layer layered in this order;

joining the first Si layer to the third Si layer; and removing the second Si layer and the fourth Si layer.

8. The manufacturing method of the orifice plate according to claim 7, further comprising:

removing the first insulating layer and the second insulating layer, after removing the second Si layer and the fourth Si layer.

9. A manufacturing method of a liquid discharge head including an orifice plate having a discharge port for discharging a liquid and a communication portion which communicates with the discharge port, and a channel substrate provided with a liquid chamber which communicate with the communication portion, the method comprising:

etching a first Si layer of a first SOI substrate by use of a first insulating layer as an etching stop layer to form the discharge port at the first Si layer, the first SOI substrate being constituted by the first Si layer, the first insulating layer and a second Si layer layered in this order;

etching a third Si layer of a second SOI substrate by use of a second insulating layer as an etching stop layer to form the communication portion at the third Si layer, the second SOI substrate being constituted by the third Si layer, the second insulating layer and a fourth Si layer layered in this order;

joining the first Si layer to the third Si layer;

removing the fourth Si layer;

joining the third Si layer to the channel substrate so that the communication portion communicates with the liquid chambers; and removing the second Si layer.

* * * * *